US005273009A

United States Patent [19]

Ozawa et al.

[11] Patent Number: 5,273,009

[45] Date of Patent: Dec. 28, 1993

[54] SILICON-NITRIDE-INSERTED PISTON

[75] Inventors: Tadao Ozawa; Yukio Miyairi, both of Nagoya, Japan

[73] Assignee: NGK Insulators, Ltd., Nagoya, Japan

[21] Appl. No.: 933,230

[22] Filed: Aug. 21, 1992

[30] Foreign Application Priority Data

Aug. 26, 1991 [JP] Japan ..... 3-238692

[51] Int. Cl.[5] ..... F02F 3/04

[52] U.S. Cl. ..... 123/193.6; 29/888.042; 29/888.047; 92/212

[58] Field of Search ..... 123/193.6; 29/888.04, 29/888.042, 888.044, 888.047; 92/222, 212

[56] References Cited

U.S. PATENT DOCUMENTS

| | | | |
|---|---|---|---|
| 4,494,501 | 1/1985 | Ludovico | 123/193.6 |
| 4,495,684 | 1/1985 | Sander et al. | 123/193.6 |
| 4,506,593 | 3/1985 | Sugiyama et al. | 92/212 |
| 4,838,149 | 6/1989 | Donnison et al. | 123/193.6 |
| 4,942,804 | 7/1990 | Matsuura et al. | 123/193.6 |
| 5,121,722 | 6/1992 | Horiuchi | 123/193.6 |

FOREIGN PATENT DOCUMENTS

| | | | |
|---|---|---|---|
| 2736815A1 | 3/1978 | Fed. Rep. of Germany . | |
| 3214093A1 | 10/1983 | Fed. Rep. of Germany . | |
| 3328435A1 | 3/1984 | Fed. Rep. of Germany . | |
| 54-107710 | 1/1953 | Japan . | |
| 56-17705 | 4/1981 | Japan . | |
| 0045757 | 3/1985 | Japan | 123/193.6 |
| 0240857 | 11/1985 | Japan | 123/193.6 |
| 1-41878 | 12/1989 | Japan . | |
| 1-41879 | 12/1989 | Japan . | |
| 1588515 | 4/1981 | United Kingdom . | |
| 2133856A | 8/1984 | United Kingdom . | |

OTHER PUBLICATIONS

Walzer, P. et al. "Alternative Materials for Automotive Engines" MTZ Motortechnische Zeitschrift 46 (1935) 5, pp. 155–160.

*Primary Examiner*—Tony M. Argenbright
*Assistant Examiner*—M. Macy
*Attorney, Agent, or Firm*—Shea & Gould

[57] ABSTRACT

A metal of which the body of a piston is formed contains iron as its main component, and the configuration of a silicon nitride member, the high-temperature strength of the silicon nitride material that composes the silicon nitride member, the melting point of the iron-containing metallic material and the inserting conditions satisfy the following formulae (1) and (2) or formulae (3) and (4):

$$k_1 \cdot \Delta T \cdot (1/R_1 - 1/R_2) + k_2 \cdot l^2 \cdot \Delta T < 0.5\,\sigma_c \quad (1)$$

$$T_c = T_m - 0.413 \cdot l \cdot \Delta T \quad (2)$$

$$k_1 \cdot T_m \cdot (1/R_1 - 1/R_2) + k_2 \cdot l^2 \cdot T_m < 0.5\sigma_c \quad (3)$$

$$T_c = T_m - 0.413 \cdot l \cdot T_m \quad (4)$$

The joint between the silicon nitride member and the metallic material need not be subjected to machining. Therefore, the manufacturing process is simple and the cost is low. Furthermore, only a low level of stress is generated in the silicon nitride member at low temperatures. Also, the joint between the silicon nitride member and the metal body has a high strength, hence, a high reliability, even at high temperatures, and the silicon nitride member hardly breaks during insert-casting.

7 Claims, 4 Drawing Sheets $$\sigma_{E2}=K_1\cdot Tm\cdot\left(\frac{1}{R_1}-\frac{1}{R_2}\right)+K_2\cdot\ell^2\cdot Tm$$

$K_1=0.25$
$K_2=0.05$ $$\sigma_{E1}=K_1\cdot\Delta T\cdot\left(\frac{1}{R_1}-\frac{1}{R_2}\right)+K_2\cdot l^2\cdot\Delta T$$

$$\sigma_{E2}=K_1\cdot Tm\cdot\left(\frac{1}{R_1}-\frac{1}{R_2}\right)+K_2\cdot l^2\cdot Tm$$

$K_1=0.25$
$K_2=0.05$

SILICON-NITRIDE-INSERTED PISTON

BACKGROUND OF THE INVENTION AND RELATED ART STATEMENT

The present invention relates to a silicon-nitride-inserted piston which is meant for an internal combustion engine consisting of a composite structure obtained by insert-casting of a silicon nitride and a metallic material. Some of the advantages of the invention include low manufacturing cost of the piston, as well as a simple manufacturing process, and at low temperatures, only a low level of stress is generated in the silicon nitride. Even at high temperatures, the joint between the silicon nitride and the metal body maintains a high level of strength, or in other words, a high level of strength reliability, thereby, being free from breakage during production.

In recent years, active research and development has been conducted regarding mechanical structure components which utilize the excellent heat resistant, wear resistant and heat-insulating properties of silicon nitride. Since silicon nitride is more brittle than metal, it is often difficult to use silicon nitride as the sole material that forms a structural component and it is generally used in the form of a composite body, in combination with a metal.

Methods known for joining a silicon nitride and a metal include: joining them through shrink-fitting, force-fitting or brazing. All of these methods, however, require the sintered silicon nitride body to be ground with a diamond grindstone or the like so that the surface of the body is finished with a high level of precision. The problem arises during this last process which requires a high production cost.

In order to cope with the above problem, it has been proposed to achieve joining by insert-casting, a process which does not require the grinding of the outer periphery of the silicon nitride. However, an insert-casting employing an aluminum alloy, a common piston material, entails a problem in that the aluminum alloy has a greater coefficient of thermal expansion than the silicon nitride, resulting in loosening or gap formation occurring between the silicon nitride and the metallic material, when exposed to high temperatures.

In order to avoid this problem, it has been proposed to conduct an insert-casting by employing a metallic material composed mainly of iron, having a smaller coefficient of thermal expansion than an aluminum alloy. However, an iron-containing material has a melting point higher than that of an aluminum alloy, thereby presenting another problem. The pouring temperature during insert-casting is inevitably raised, causing the generation of excessive stress in the silicon nitride during the insert-casting, and thus increasing the risk of breakdown of the silicon nitride.

The present invention is directed toward overcoming the conventionally entailed problems, solvable by providing a silicon-nitride-inserted piston for an internal combustion engine consisting of a composite structure obtained by insert-casting of a silicon nitride and a metallic material. Machining is unnecessary for the joining of the silicon nitride and the metallic material, hence the composite is producible by a small number of production processes at a low production cost and the silicon nitride is hardly vulnerable to breakage during insert-casting.

SUMMARY OF THE INVENTION

In order to achieve the above object, the present invention provides a silicon-nitride-inserted piston for an internal combustion engine, the piston having a silicon nitride member inserted in an upper portion of the piston, the member defining therein a combustion space. The piston is characterized in that (a) a piston body is formed of a metallic material containing iron as the main component thereof, and (b) the configuration of the silicon nitride member, the high-temperature strength the silicon nitride material that composes the silicon nitride member, the melting point of the iron-containing metallic material, and the inserting conditions satisfy the following formulae (1) and (2):

$$k_1 \cdot \Delta T \cdot (1/R_1 - 1/R_2) + k_2 \cdot l^2 \cdot \Delta T < 0.5\sigma_c \quad (1)$$

$$T_c = T_m - 0.413\text{cm}^{-1} l \cdot \Delta T \quad (2)$$

(where $k_1 = 0.25$(MPa/cm °C.) and $k_2 = 0.05$(MPa/cm$^2$ °C.); $\sigma_c$ (MPa): the four-point bending strength of the silicon nitride material at the temperature $T_c$ (°C.); $T_m$ (°C.): the melting point of the iron-containing metallic material forming said piston body; $\Delta T$(°C.): the difference between the preheating temperature of the said silicon nitride member during insertion and the melting point $T_m$ (°C.) of the iron-containing metallic material forming said piston body; $R_1$, $R_2$: A section is taken through the plane including the central axis of said combustion space and the central axis of said piston. The points at which the central axis of said combustion space intersects the external surface of the silicon nitride member and where it intersects the combustion space contour are joined by segment TO. In the smaller region partitioned by segment TO, segment PQ parallel to the central axis of said combustion space represents the region where the thickness of the silicon nitride member is at a minimum. Segment PQ divides the region into section $S_1$ and $S_2$, which are, respectively, distal to and proximal to, the central axis of the said combustion space. $R_1$ is the value obtained by dividing the sectional area $S_1$ by the length of curve SQ, which joins point S, where the outer contour of the silicon nitride member and the upper surface of the silicon nitride member intersect, and point Q along the external surface of the silicon nitride member. $R_2$ is the value obtained by dividing the sectional area $S_2$ by the length of curve QT extending along the outer surface of the silicon nitride member's outer contour from the point Q to the point T, and l is the length of the segment PQ.)

The present invention also provides a silicon-nitride-inserted piston characterized in that the configuration of a silicon nitride member, the high-temperature strength of the silicon nitride material that composes the silicon nitride member, and the melting point of an iron-containing metallic material satisfy the following formulae (3) and (4):

$$k_1 \cdot T_m \cdot (1/R_1 - 1/R_2) + k_2 \cdot l^2 \cdot T_m < 0.5\sigma_o \quad (3)$$

$$T_c = T_m - 0.413\text{cm}^{-1} \cdot l \cdot T_m \quad (4)$$

(where $k_1 = 0.25$ (MPa/cm °C.) and $k_2 = 0.05$ (MPa/cm$^2$ °C.) $\sigma_c$ (MPa): the four-point bending strength of the silicon nitride material at the temperature $T_c$(°C.); $T_m$(°C.): the melting point of the iron-containing metallic material forming said piston body; $R_1$, $R_2$: A section is taken through the plane including the central axis of said combustion space and the central axis of said piston. The points at which the central axis of said combustion space intersects the external surface of the silicon nitride member and where it intersects the combustion space contour are joined by segment TO. In the smaller region partitioned by segment TO, segment PQ parallel to the central axis of said combustion space represents the region where the thickness of the silicon nitride member is at a minimum. Segment PQ divides the said region into section $S_1$ and $S_2$, which are, respectively, distal to and proximal to, the central axis of the said combustion space. $R_1$ is the value obtained by dividing the sectional area $S_1$ by the length of curve SQ, which joins point S, where the outer contour of the silicon nitride member and the upper surface of the silicon nitride member intersect, and point Q along the external surface of the silicon nitride member. $R_2$ is the value obtained by dividing the sectional area $S_2$ by the length of curve QT extending along the outer surface of the silicon nitride member's outer contour from the point Q to the point T, and l is the length of the segment PQ.)

DETAILED DESCRIPTION OF PREFERRED EMBODIMENTS

Figure 1:
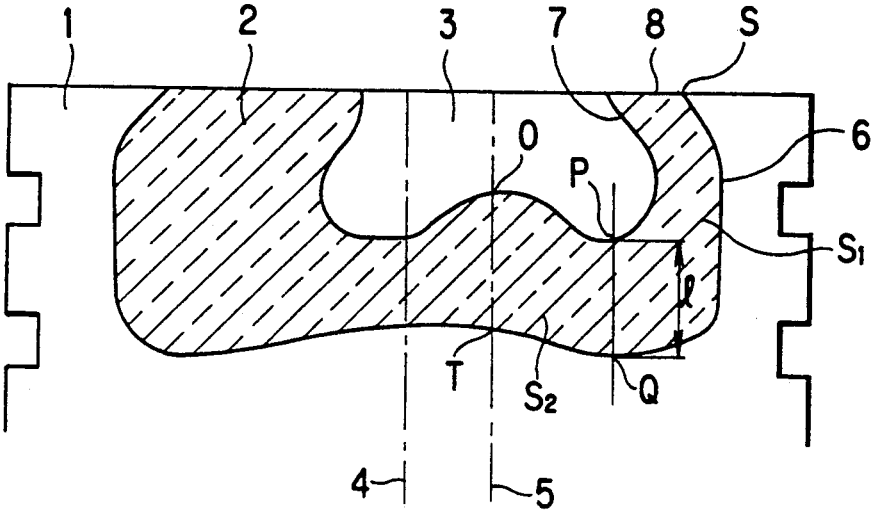
FIG. 1 is a sectional view illustrating the upper portion of a silicon-nitride-inserted piston.

The present invention will not be described in detail. According to the present invention, in order to produce a silicon-nitride-inserted piston, the metallic material used in the insert-casting should preferably be an iron-containing alloy having a coefficient of thermal expansion within the range of $3.5\times10^{-6}$ to $9.0\times10^{-6}$/°C. at temperatures ranging from room temperature to 400° C. The coefficient of thermal expansion should be as close as possible to the coefficient of thermal expansion of the silicon nitride material so as to prevent the occurrence of loosening or gap formation between the silicon nitride member and the metallic material during use.

A favorable iron-containing metallic material having a coefficient of thermal expansion within the above-stated range is, for example, an alloy having a chemical composition of, in weight %, 0.3 to 2.0% of C, 25 to 32% of Ni, 12 to 20% of Co, 0.3 to 2.0% of Si, 0.2 to 0.8% of Nb, 0.01 to 0.2% of Mg or Ca, and not more than 1.0% of Mn, the balance being Fe and impurities, the alloy having a coefficient of thermal expansion of $3.5\times10^{-6}$ to $9.0\times10^{-6}$/°C. at temperatures ranging from room temperature to 400° C. Another preferable example is an alloy having a chemical composition of, in weight %, 0.8 to 3.0% of C, 30 to 34% of Ni, 4.0 to 6.0% of Co, 1.0 to 3.0% of Si, not more than 2.0% of Mn, not more than 1.0% of sulfur, not more than 1.5% of phosphorus, and not more than 1.0% of Mg, the balance being Fe and impurities, the second alloy having a coefficient of thermal expansion of not more than $9.0\times10^{-6}$/°C. at temperatures ranging from room temperature to 400° C., and a coefficient of thermal expansion between $2\times10^{-6}$ to $3\times10^{-6}$/°C. at temperatures from room temperature to 200° C.

Iron-containing metallic materials discussed above are preferable because with such alloys, graphite (having a density of approximately 2 g/cm$^3$) precipitates from the liquid metal (having density of approximately 8 g/cm$^3$) during solidification so that the amount of solidification shrinkage is reduced, resulting in the amount of the total shrinkage that takes place until the temperature lowers to room temperature being smaller than that of low thermal expansion alloys such as invar alloys and Kovar. Another reason is that an iron-containing metallic material which does not have the chemical composition stated above does not have a coefficient of thermal expansion which is closer to that of a silicon nitride member than is that of a common iron-containing material, and of enabling insert-casting.

The melting point of an iron-containing metallic material is usually 1500° C. or thereabout. If such a metallic material is used to insert-cast a silicon nitride member, the silicon nitride member is subjected to transient thermal stress during the pouring process, when it is brought into contact with a high-temperature molten metallic material. The above-stated formula (1), according to the present invention, specifies conditions of the configuration of the silicon nitride member, the iron-containing metallic material and silicon nitride member preheating temperature, all of which do not involve the risk of the silicon nitride member being broken down by the thermal stress. The first term on the left side of the formula (1) corresponds to the thermal stress than can be generated at the lower areas of the combustion-space-defining inner surface due to the difference in the average temperature between the central portion and the outer peripheral portion of the silicon nitride member, while the second term corresponds to the thermal stress that can be generated on the combustion-space-defining inner surface due to the temperature gradient across the thickness of the silicon nitride member. In formula (1), the coefficients $k_1$ and $k_2$ are functions of the thermal expansion coefficient of the silicon nitride material, the Young's modulus, the specific heat, the density, and the coefficient of heat transfer between the molten metallic material and the silicon nitride member. However, it was confirmed through experiments that, within the normally possible ranges of the physical properties of silicon nitride material and the heat transfer coefficient during the pouring of the iron-containing metallic material, $k_1$ and $k_2$ have constant values, that is, $k_1=0.25$ (MPa/cm °C.) and $k_2=0.05$ (MPa/cm$^2$ °C.).

As formula (2) clearly shows, preheating the silicon nitride member prior to pouring the molten metallic material is advantageous in preventing cracking under thermal stress of the silicon nitride member. However, this calls for the increase of the number of production processes and therefore, is deemed unpreferable.

According to the present invention, in order to prevent the silicon nitride member from cracking without the additional process of preheating, it is more preferable that the four-point bending strength $\sigma_c$ of the silicon nitride material at the temperature $T_c$ (°C.) expressed in terms of the melting point $T_m$ (°C.) of the iron-containing metallic material, as in the formula (4), have the relationship with $R_1$, $R_2$, l, and $T_m$ specified in the formula (3).

EMBODIMENTS

The present invention will now be described in further detail with respect to embodiments thereof. However, it is to be understood that the present invention is not limited to these embodiments.

(Embodiment 1)

FIG. 1 is an explanatory sectional view showing the upper portion of a silicon-nitride-inserted piston. The construction of the piston is such that a silicon nitride member 2 defining therein a combustion space 3 is insert-casted into a structure integral with a metal 1 (constituting a piston body).

In the piston shown in FIG. 1, a section of the silicon nitride member taken through the plane including the central axis 5 of the combustion space and the central axis 4 of the piston is divided by a segment TO joining together the points T and O at which the axis 5 intersects an outer contour 6 of the silicon nitride member 2 and a combustion space contour 7, thereby dividing the section of the silicon nitride member 2 into two parts. The section on the right is examined further.

Here another segment PQ is the segment so positioned as to have a minimum length with which it joins together the respective intersections where a straight line parallel to the segment TO intersects the combustion space contour 7 and the outer contour 6 of the silicon nitride member 2, the length of the segment PQ being expressed as l. A first sectional area $S_1$ is defined by the segment PQ, a first part of the combustion space contour 7, the upper surface 8 of the silicon nitride member 2, and a first part of the outer contour 6 of the silicon nitride member 2. A second sectional area $S_2$ is defined by the segment PQ, a second part of the combustion space contour 7, the segment TO, and a second part of the outer contour 6 of the silicon nitride member 2.

The value obtained by dividing $S_1$ by the length of a curve SQ extending along the first part of the outer contour 6 of the silicon nitride member 2 from an intersection S of the upper surface 8 of the silicon nitride member 2 and the outer contour 6 of the silicon nitride member 2 to the point Q, is expressed as $R_1$, and the value obtained by dividing $S_2$ by the length of another curve QT extending along the second part of the outer contour 6 of the silicon nitride member 2 from the point Q to the point T, is expressed as $R_2$.

With the construction discussed above, insert-casting experiments were conducted by varying the configuration of the combustion space, the chemical composition of the metallic material, the silicon nitride material, and/or the silicon nitride member preheating temperature.

Figure 4:
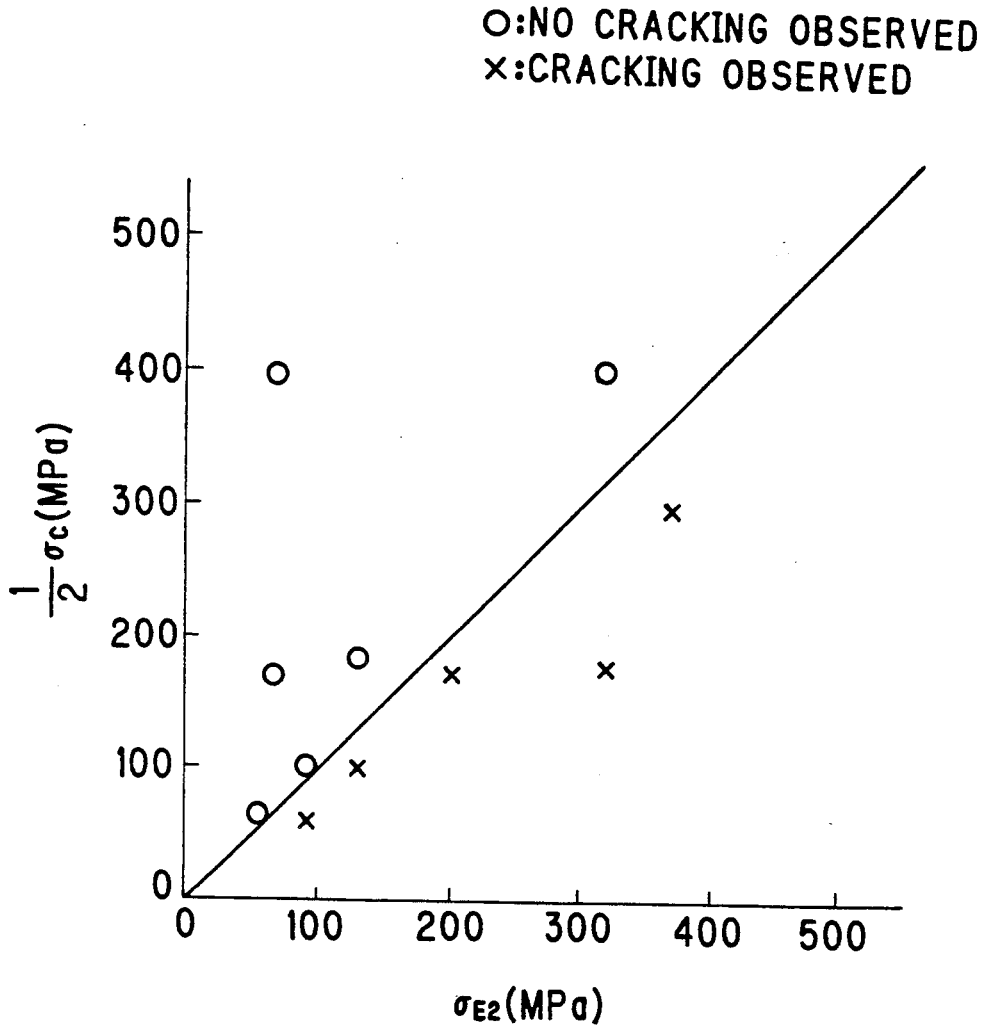
FIG. 4 is a graph illustrating the results, among those shown in Table 1, obtained when the silicon nitride member was not preheated.
Figure 5:
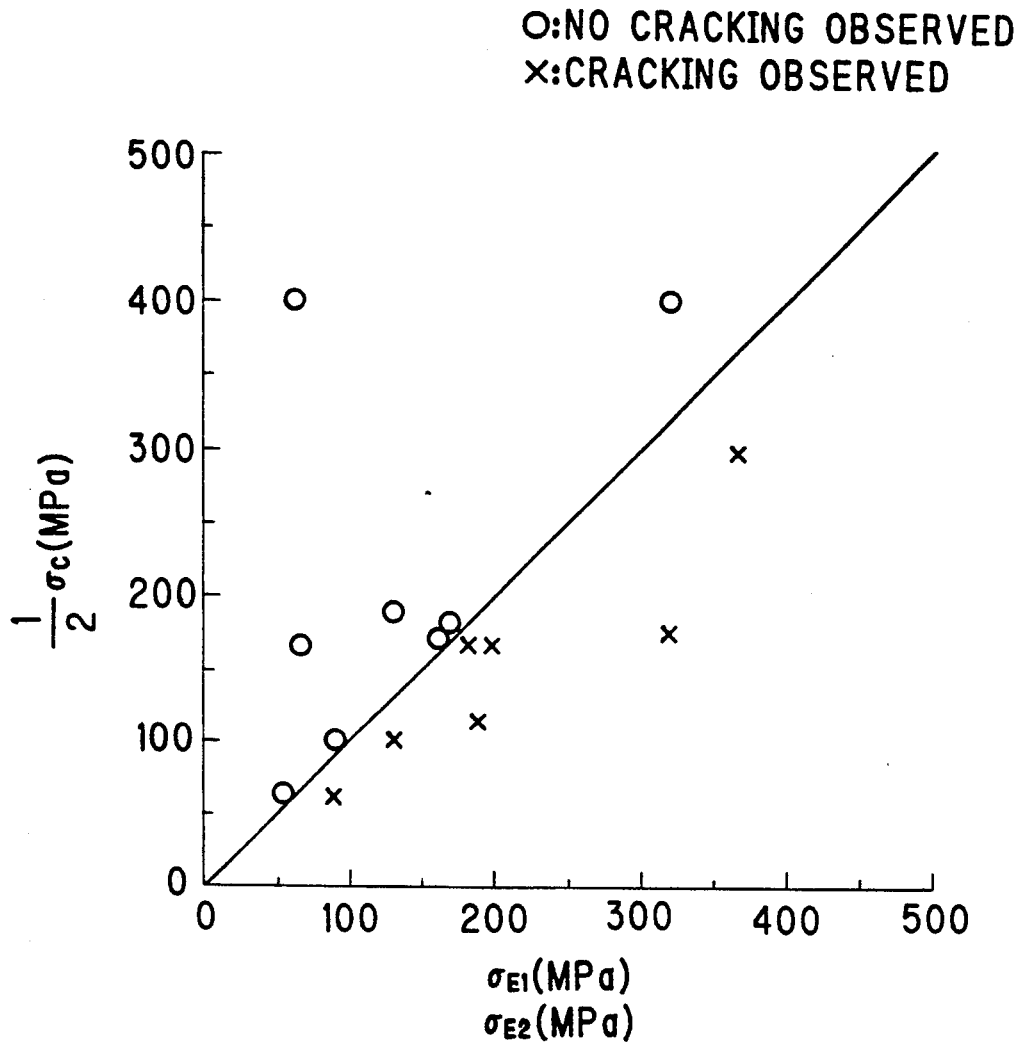
FIG. 5 is a graph showing the results shown in Table 1.

The results shown in Table 1. are illustrated in a graph in FIG. 4. Among those shown in Table 1, are data obtained when no preheating treatment of the silicon nitride member was conducted. FIG. 5 is a graph representing all of the results shown in Table 1 and FIGS. 4 and 5, the symbol × represents the fact that the cracking of the silicon nitride member was observed during insert-casting, and the symbol ○ represents the fact that the silicon nitride member was able to withstand the thermal stress.

As is clear from the Table 1 and FIGS. 4 and 5, it is necessary to adopt conditions satisfying the formula (1) or (3), in order to prevent the silicon nitride member from cracking under thermal stress.

[TABLE 1]

| Run No. | SQ (cm) | $S_1$ ($cm^2$) | $R_1$ | QT (cm) | $S_2$ ($cm^2$) | $R_2$ | l (cm) | $T_m$ (°C.) | $T_C$ (°C.) | ΔT (°C.) | $\sigma_E$ (MPa) | $0.5\sigma_C$ (MPa) | Result of insert-catsing |
|---|---|---|---|---|---|---|---|---|---|---|---|---|---|
| The Present Invention | | | | | | | | | | | | | |
| 1 | 4.2 | 3.2 | 0.76 | 2.0 | 1.7 | 0.85 | 0.5 | 1400 | 1115 | — | 65 | 170 | ○ |
| 2 | 4.2 | 3.2 | 0.76 | 2.0 | 1.7 | 0.85 | 0.5 | 1400 | 1115 | — | 65 | 400 | ○ |
| 3 | 3.4 | 2.2 | 0.65 | 2.5 | 3.6 | 1.45 | 0.6 | 1300 | 1128 | 700 | 166 | 170 | ○ |
| 4 | 4.9 | 2.8 | 0.57 | 1.8 | 1.8 | 1.0 | 0.7 | 1300 | 1069 | 800 | 170 | 177 | ○ |
| 5 | 3.4 | 2.2 | 0.65 | 2.5 | 3.6 | 1.45 | 0.6 | 1400 | 1058 | — | 318 | 400 | ○ |
| 6 | 5.3 | 6.7 | 1.26 | 3.7 | 9.3 | 2.51 | 0.8 | 1400 | 944 | — | 92 | 100 | ○ |
| 7 | 5.7 | 8.3 | 1.46 | 3.3 | 7.8 | 2.36 | 0.6 | 1400 | 1038 | — | 56 | 60 | ○ |
| 8 | 7.5 | 11.3 | 1.51 | 6.0 | 25.0 | 4.17 | 0.9 | 1400 | 887 | — | 128 | 190 | ○ |
| Comparative Example | | | | | | | | | | | | | |
| 9 | 5.3 | 6.7 | 1.26 | 3.7 | 9.3 | 2.51 | 0.8 | 1400 | 944 | — | 92 | 65 | x |
| 10 | 8.2 | 11.3 | 1.37 | 6.0 | 25.0 | 4.17 | 0.7 | 1400 | 1001 | — | 201 | 175 | x |
| 11 | 13.0 | 11.3 | 0.87 | 6.0 | 25.0 | 4.17 | 0.9 | 1400 | 1001 | — | 367 | 300 | x |
| 12 | 3.4 | 2.2 | 0.65 | 2.5 | 3.6 | 1.45 | 0.6 | 1400 | 1058 | — | 318 | 180 | x |
| 13 | 3.4 | 2.2 | 0.65 | 2.5 | 3.6 | 1.45 | 0.6 | 1300 | 1089 | 800 | 184 | 175 | x |
| 14 | 4.9 | 2.8 | 0.57 | 1.8 | 1.8 | 1.0 | 0.7 | 1400 | 1140 | 900 | 192 | 165 | x |
| 15 | 7.5 | 11.3 | 1.51 | 6.0 | 25.0 | 4.17 | 0.9 | 1400 | 887 | — | 128 | 100 | x |

)Embodiment 2)

Figure 2:
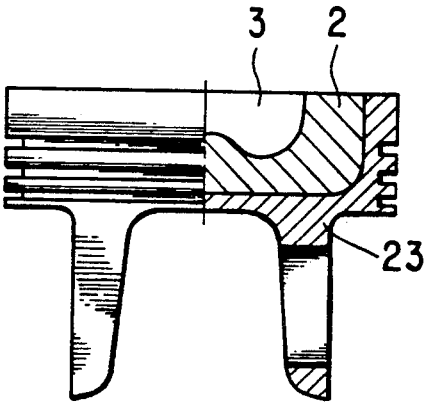
FIG. 2 is a sectional view which embodies a silicon-nitride-inserted piston according to the present invention.

FIG. 2 is a sectional view which embodies a silicon-nitride-inserted piston according to the present invention. The embodiment is an example of a two-piece piston for a diesel engine whose construction is such that a piston combustion space 3 is defined by a silicon nitride member 2 having a four-point bending strength of 800 MPa at 1100° C., the member 2 being insert-casted into a structure integral with an iron-containing alloy 23 mainly containing Fe and Ni.

In this example only the crown portion of the two-piece piston is formed as a structure obtained by insert-casting of the silicon nitride member 2 and the iron-containing alloy 23. Thus, the embodiment, in which the cavity constituting the piston combustion space 3 is defined by the silicon nitride member having a greater heat-transfer resistance per unit weight than an aluminum alloy or an iron-containing material, and in which the silicon nitride member is insert-casted into a structure integral with the iron-containing material 23 forming the piston body, is directed to reducing the loss of heat transfer from the combustion gas within the combustion space to the combustion-space-defining wall surface, and also to improving the heat resistance of the portion where the opening of the combustion space is formed, so as to prevent the problems which are entailed by a metallic material piston such as burning of open areas and crack formation.

The adoption of certain conditions satisfying the formulas (1) and (3) according to the present invention has enabled the production of this embodiment.

Figure 3:
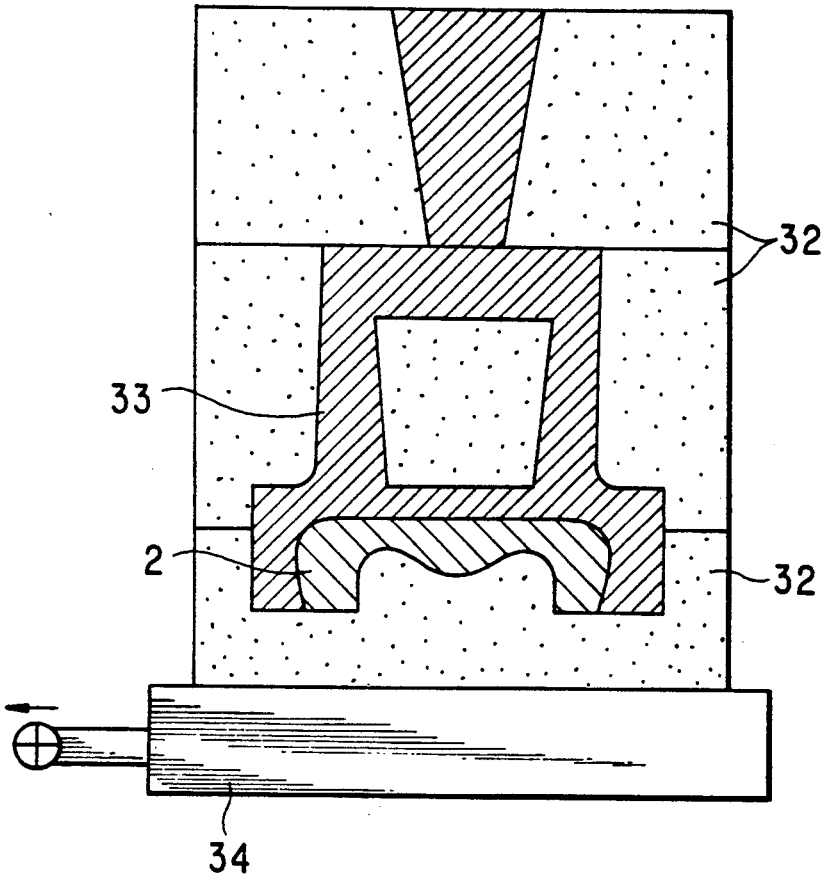
FIG. 3 is a sectional view showing a method for insert-casting the embodiment illustrated in FIG. 2.

FIG. 3 shows an example of a method for insert-casting the embodiment shown in FIG. 2. In FIG. 3, reference numerals 32 together denote a mold, reference numeral 33 denotes a low thermal expansion cast iron, and reference numeral 34 denotes a suction device.

A silicon nitride member 2, having a sintered outer peripheral surface which has not been ground, was set in the mold 32. Thereafter, a molten metallic material of a low thermal expansion cast iron 33 at 1450° C. having a chemical composition in weight %, 1.2% of C, 1.2% of Si, not more than 0.3% of Mn, 28% of Ni, 14% of Co, 0.03% of Mg, and 0.3% of Nb, was poured into the mold 32 while the suction device 34 continuously reduced the pressure produced. After the contents of the mold had been gradually cooled to room temperature, they were removed from the mold 32, thereby obtaining a silicon-nitride-metal composite body. Then, the metallic material outer periphery was machined.

As has been described above, a silicon-nitride-inserted piston constructed to satisfy the various conditions specified by the present invention makes it possible to realize a silicon-nitride-inserted piston for an internal combustion engine consisting of a composite body obtained by insert-casting of a silicon nitride member and a metallic material. The piston being advantageous in that: the joint between the silicon nitride member and the metallic material need not be subjected to machining, so that the manufacturing process is simple, and the cost is low; only a low level of stress is generated in the silicon nitride member at low temperatures; the joint between the metal body and the silicon nitride member has a high level of strength, hence, a high level of strength reliability, even at high temperatures; and the silicon nitride member is hardly vulnerable to breakage during insert-casting.

What is claimed is:

1. A silicon-nitride-inserted piston for use in an internal combustion engine, the silicon-nitride-inserted piston comprising:

a piston body formed of an iron-containing metallic material, said piston body having a cavity formed therein; and a silicon nitride member insert-casted with the iron-metallic material, wherein an outer contour of said silicon nitride member is in direct contact with the cavity of said piston body, and an inner contour of said silicon nitride member forms a combustion space for the silicon-nitride-inserted piston, wherein said silicon nitride member has a four-point bending strength $\sigma_c$ at a temperature $T_c$ represented by the following formulae:

$$k_1 \times \Delta T \times (1/R_1) - 1R_2 + k_2 \times l^2 \times \Delta T < 0.5\sigma_c,$$

wherein $$T_c = T_m - 0.413cm^{-1} \times l \times \Delta T,$$

and wherein $T_m$ is the melting point of the iron containing metallic material forming said piston body; $\Delta T$ represents the difference between a preheating temperature of said silicon nitride member during insertion and $T_m$; $k_1$ is 0.25; $k_2$ is 0.05; $R_1$ is obtained by dividing a first portion of a cross sectional area of the silicon nitride member by the outer contour of said silicon nitride member corresponding to the first portion; $R_2$ is obtained by dividing a second portion of the cross sectional area of said silicon nitride member by the outer contour of said silicon nitride member corresponding to the second portion; and l is a thickness value of the cross sectional area measured at a boundary formed by the first and second portions of the cross sectional area.

2. A silicon-nitride-inserted piston for use in an internal combustion engine, the silicon-nitride-inserted piston comprising:

a piston body formed of an iron-containing metallic material, said piston body having a cavity formed therein; and a silicon nitride member insert-casted with the iron-metallic material, wherein an outer contour of said silicon nitride member is in direct contact with the cavity of said piston body, and an inner contour of said silicon nitride member forms a combustion space for the silicon-nitride-inserted piston;

wherein said silicon nitride member has a four-point bending strength $\sigma_c$ at a temperature $T_c$ represented by the following formulae:

$$k_1 \times T_m \times (1/R_1 - 1/R_2) + k_2 \times l^2 \times T_m < 0.5\sigma_c,$$

wherein $$T_c = T_m - 0.413cm^{-1} \times l \times t_m,$$

and wherein $T_m$ is the melting point of the iron containing metallic material forming said piston body; $k_1$ is 0.25; $k_2$ is 0.05; $R_1$ is obtained by dividing a first portion of a cross sectional area of the silicon nitride member by the outer contour of said silicon nitride member corresponding to the first portion; $R_2$ is obtained by dividing a second portion of the cross sectional area of said silicon nitride member by the outer contour of said silicon nitride member corresponding to the second portion; and l is a thickness value of the cross sectional area measured at a boundary formed by the first and second portions of the cross sectional area.

3. The silicon-nitride-inserted piston according to claim 1 or 2, wherein the second portion of said cross sectional area of said silicon nitride member is defined by boundary lines TO and PQ to from an area $S_2$, wherein the boundary line TO is formed by a central axis of the combustion space as the central axis intersects the inner contour of said silicon nitride member at a point O and intersects the outer contour of said silicon nitride member at a point T, and the boundary line PQ is formed by an axis parallel to the central axis of the combustion space, located at a region of said silicon nitride member which is a minimum in thickness, and intersecting the inner and outer contours of said silicon nitride member at points P and Q, respectively, and wherein the first portion of said cross sectional area of said silicon nitride member is defined by the boundary line PQ and an upper surface of said silicon nitride member to form an area $S_1$, the upper surface of said silicon nitride member and the outer contour of said silicon nitride member intersecting at a point S; and wherein $R_1$ is derived by dividing the area $S_1$ by the outer contour length between points Q and S, and $R_2$ is derived by dividing the area $S_2$ by the outer contour length between points Q and T.

4. The silicon-nitride-inserted piston according to claim 3, wherein the cavity formed in said piston body has cavity walls that taper inwards towards the center of the cavity at the top of the piston so as to form an opening at the top of the piston which is smaller than the body of the cavity.

5. A silicon-nitride-inserted piston according to claim 1 or 2, wherein the metallic material is an iron-containing alloy having a coefficient of thermal expansion within the range of $3.5\times10^{-6}$ to $9.0\times10^{-6}$/°C. at temperatures ranging from room temperature to 400° C.

6. A silicon-nitride-inserted piston according to claim 1 or 2, wherein the metallic material is an alloy having a chemical composition of, in weight %, 0.3 to 2.0% of C, 25 to 32% of Ni, 12 to 20% of Co, 0.3 to 2.0% of Si, 0.2 to 0.8% of Nb, 0.01 to 0.2% of Mg or Ca, and not more than 1.0% of Mn, the balance being Fe and impurities, the alloy having a coefficient of thermal expansion of $3.5\times10^{-6}$ to $9.0\times10^{-6}$/°C. at temperatures ranging from room temperature to 400° C.

7. A silicon-nitride-inserted piston according to claim 1 or 2, wherein the metallic material is an alloy having a chemical composition of, in weight % 0.8 to 3.0% of C, 30 to 34% of Ni, 4.0 to 6.0% of Co, 1.0 to 3.0% Si, not more than 2.0% of Mn, not more than 1.0% of sulfur, not more than 1.5% of phosphorus, and not more than 1.0% of Mg, the balance being Fe and impurities, the alloy having a coefficient of thermal expansion of not more than $9.0\times10^{-6}$/°C. at temperatures ranging from room temperature to 400° C., and a coefficient of thermal expansion between $2\times10^{-6}$ to $3\times10^{-6}$/°C. at temperatures from room temperature to 200° C.

* * * * *